US010276918B2

(12) United States Patent
Takasu

(10) Patent No.: US 10,276,918 B2
(45) Date of Patent: Apr. 30, 2019

(54) SYSTEM AND ELECTRONIC DEVICE

(71) Applicants: KABUSHIKI KAISHA TOSHIBA, Minato-ku, Tokyo (JP); Toshiba Client Solutions CO., LTD, Koto-ku, Tokyo (JP)

(72) Inventor: Nobuaki Takasu, Tokyo (JP)

(73) Assignee: Toshiba Client Solutions Co., LTD, Tokyo (JP)

( * ) Notice: Subject to any disclaimer, the term of this patent is extended or adjusted under 35 U.S.C. 154(b) by 84 days.

(21) Appl. No.: 15/399,417

(22) Filed: Jan. 5, 2017

(65) Prior Publication Data

US 2017/0194689 A1 Jul. 6, 2017

Related U.S. Application Data

(60) Provisional application No. 62/275,748, filed on Jan. 6, 2016.

(51) Int. Cl.
*H01Q 1/22* (2006.01)
*H01Q 3/24* (2006.01)

(52) U.S. Cl.
CPC ..... *H01Q 1/2258* (2013.01); *H01Q 1/2266* (2013.01); *H01Q 3/24* (2013.01)

(58) Field of Classification Search
CPC ..... H01Q 1/2258; H01Q 3/24; H04B 7/0805
See application file for complete search history.

(56) References Cited

U.S. PATENT DOCUMENTS 8,654,030 B1 * 2/2014 Mercer ..... H04B 1/3833 343/702
8,792,930 B1 * 7/2014 Gopalakrishnan ..... H01Q 1/243 455/522
2003/0198008 A1 10/2003 Leapman et al.
2006/0276221 A1 * 12/2006 Lagnado ..... G06F 1/162 455/552.1
2007/0252823 A1 * 11/2007 Hirota ..... G06F 1/1618 345/173
2007/0273594 A1 * 11/2007 Shimasaki ..... G06F 1/162 343/702
2008/0068271 A1 * 3/2008 Iwai ..... H01Q 1/245 343/702
2008/0085736 A1 * 4/2008 Kitamura ..... G06F 1/162 455/557

(Continued)

FOREIGN PATENT DOCUMENTS

JP 2003-345463 12/2003
JP 2005-284434 10/2005
JP 2014-232849 12/2014

*Primary Examiner* — Dieu Hien T Duong
*Assistant Examiner* — Bamidele A Jegede
(74) *Attorney, Agent, or Firm* — Rutan & Tucker, LLP

(57) ABSTRACT

According to certain embodiments, a system includes a first electronic device and a second electronic device. The first electronic device is detachably and rotatably connected to the second electronic device. The at least two pairs of antennae are arranged such that each antenna exclusively used for transmission respectively faces each corresponding antenna exclusively used for reception between the first and second electronic devices, and the antennae are bilaterally symmetrical with respect to an axis of rotation of the first and second electronic devices.

15 Claims, 6 Drawing Sheets

(56) References Cited

U.S. PATENT DOCUMENTS

| | | | | |
|---|---|---|---|---|
| 2009/0322627 | A1* | 12/2009 | Sato | G06F 1/162 343/702 |
| 2009/0325528 | A1* | 12/2009 | Yokota | H04B 7/0805 455/277.1 |
| 2010/0159847 | A1* | 6/2010 | Sathath | H04B 1/0082 455/73 |
| 2010/0207621 | A1* | 8/2010 | Yano | G01R 33/0023 324/247 |
| 2010/0277304 | A1* | 11/2010 | Haartsen | G06F 1/3215 340/531 |
| 2012/0068919 | A1* | 3/2012 | Lauder | G06F 1/1626 345/156 |
| 2012/0155005 | A1* | 6/2012 | Lee | G06F 1/162 361/679.26 |
| 2014/0049911 | A1* | 2/2014 | Corbin | A45C 13/002 361/679.58 |
| 2014/0273852 | A1* | 9/2014 | McCormack | H04W 76/10 455/41.2 |
| 2014/0285310 | A1* | 9/2014 | Ito | G06F 1/162 340/3.1 |
| 2014/0355210 | A1 | 12/2014 | Hashimoto et al. | |
| 2015/0133188 | A1* | 5/2015 | Chang | G06F 1/1698 455/556.1 |

* cited by examiner

SYSTEM AND ELECTRONIC DEVICE

CROSS-REFERENCE TO RELATED APPLICATIONS

This application claims the benefit of U.S. Provisional Application No. 62/275,748, filed Jan. 6, 2016, the entire contents of which are incorporated herein by reference.

FIELD

Embodiments described herein relate generally to a system and an electronic device.

BACKGROUND

Recently, as a method for transmitting a signal between a plurality of devices at high speed, millimeter-wave communication using millimeter waves as carrier waves has become widespread. For example, millimeter-wave communication is used to transmit an interface signal in a detachable computer which detachably connects a tablet terminal and a keyboard. Some detachable computers can be selectively used as a notebook computer and a tablet computer by attaching one of the tablet terminal and the keyboard in reverse.

In millimeter-wave communication, the distance between a transmitting antenna for transmitting a signal and a receiving antenna for receiving a signal must be short to realize high-speed signal transmission because of the characteristics of millimeter waves. When millimeter-wave communication is used to transmit the interface signal between the tablet terminal and the keyboard in the detachable computer, the transmitting and receiving antennae for transmitting and receiving the interface signal are provided in both the tablet terminal and the keyboard within a distance in which high-speed signal transmission can be realized by millimeter-wave communication.

However, as described above, in the detachable computer, one of the tablet terminal and the keyboard may be reversed and connected. In this case, the transmitting and receiving antennae in the tablet terminal may be located away from those in the keyboard in a manner that the transmitting or receiving antenna in the tablet terminal cannot maintain the distance for realizing high-speed signal transmission in accordance with millimeter-wave communication with that in the keyboard. Thus, at least one of the tablet terminal and the keyboard comprises transmitting and receiving antennae used in a normal connection state, and transmitting and receiving antennae used in a reverse connection state. In this structure, even when one of the tablet terminal and the keyboard is reversed, the transmitting and receiving antennae provided in the tablet terminal and the keyboard can be located within a distance in which high-speed signal transmission can be realized in accordance with millimeter-wave communication. However, this structure increases the cost for producing the tablet terminal and the keyboard.

New technology is needed to solve the above problem.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

According to certain embodiments, a system includes a first electronic device and a second electronic device. The first electronic device is detachably and rotatably connected to the second electronic device. Each of the first and second electronic devices includes at least two pairs of antennae in order to transmit and receive a plurality of types of signals in accordance with millimeter-wave communication. The antennae has an antenna exclusively used for transmission and an antenna exclusively used for reception. The at least two pairs of antennae are arranged such that each antenna exclusively used for transmission respectively faces each corresponding antenna exclusively used for reception between the first and second electronic devices, and the antennae are bilaterally symmetrical with respect to an axis of rotation of the first and second electronic devices.

<First Embodiment>

Figure 1:
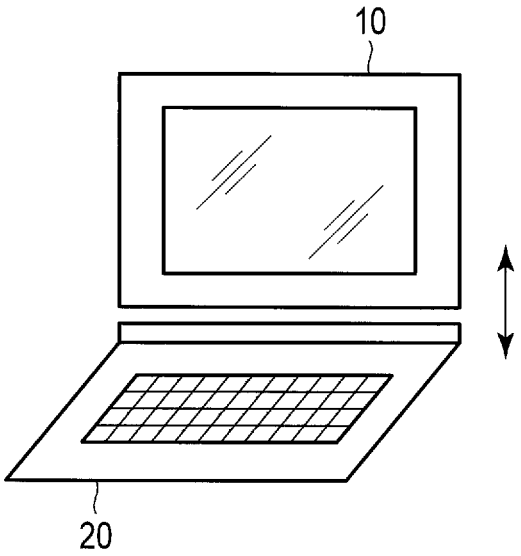
FIG. 1 is shown to explain a detachable computer according to certain embodiments.
Figure 2:
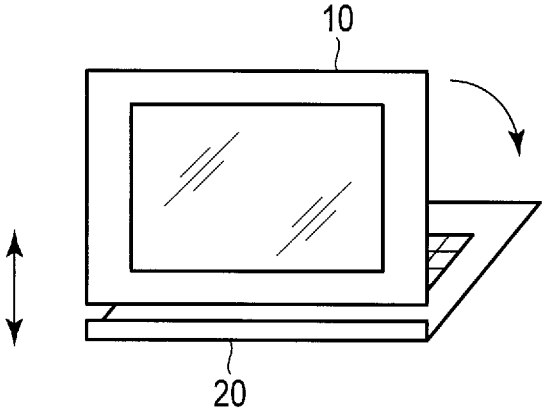
FIG. 2 is shown to explain the detachable computer according to certain embodiments.

FIG. 1 and FIG. 2 are shown to explain a detachable computer according to certain embodiments. The detachable computer is an electronic device which can be selectively used as a notebook computer and a tablet computer. The detachable computer (a millimeter-wave communication system) comprises a tablet terminal 10 and a keyboard dock 20. The tablet terminal 10 and the keyboard dock 20 are detachably connected to each other.

When the detachable computer is used as the notebook computer as shown in FIG. 1, the form is called a clamshell form. In the following explanation, a state of connection between the tablet terminal 10 and the keyboard dock 20 in the clamshell form is called a normal connection state. When the detachable computer is used as the tablet computer as shown in FIG. 2, the form is called a tablet form. In the following explanation, a state of connection between the tablet terminal 10 and the keyboard dock 20 in the tablet form is called a reverse connection state. The state of connection is called in this way for the following reason. To cause the detachable computer to transition from the clamshell form to the tablet form (or from the tablet form to the clamshell form), the tablet terminal 10 must be disconnected from the keyboard dock 20, and one of the devices 10 and 20 must be reversed. Further, they must be detachably connected to each other again.

The tablet terminal 10 and the keyboard dock 20 comprise antenna-integrated wireless transmitting and receiving chips (in other words, wireless transmitting and receiving chips having antennae built-in) for performing millimeter-wave communication. Various interface signals are transmitted in accordance with millimeter-wave communication using the antenna-integrated wireless transmitting and receiving chips between the tablet terminal 10 and the keyboard dock 20. Millimeter-wave communication is a communication system using millimeter waves as carrier waves. In general, it is known that millimeter waves have a very large absorption loss by atmospheric molecules, and a very large absorption loss and scattering loss by rain. Thus, in millimeter-wave communication using antennae, high-speed signal transmission can be realized only when the distance between the antennae is short. Specifically, the distance between the antennae is preferably less than or equal to 10 mm.

Now, this specification explains the arrangement of antenna-integrated wireless transmitting and receiving chips for realizing the high-speed transmission of interface signals in accordance with millimeter-wave communication in either the clamshell form shown in FIG. 1 or the tablet form shown in FIG. 2 when a plurality of types of interface signals are transmitted between the tablet terminal 10 and the keyboard dock 20. In the present embodiment, as a plurality of types of interface signals, a USB signal related to an interface conforming to the Universal Serial Bus (USB) standard and a PCIe signal related to an interface conforming to the PCI Express standard are transmitted using millimeter-wave communication.

Figure 3:
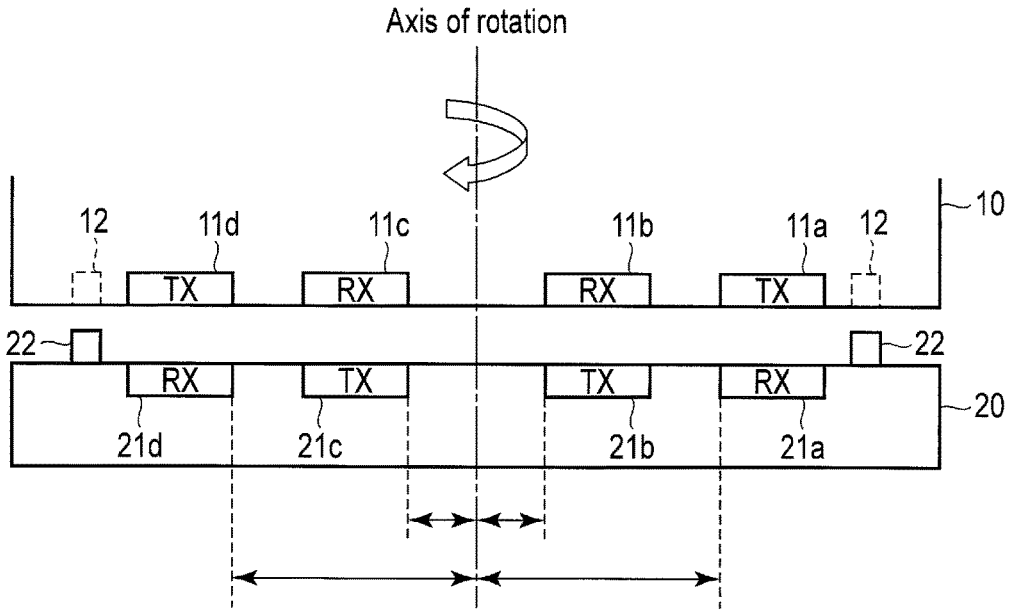
FIG. 3 shows an example of arrangement of antenna-integrated wireless transmitting and receiving chips according to a first embodiment.

FIG. 3 shows an example of arrangement of antenna-integrated wireless transmitting and receiving chips according to the first embodiment.

The tablet terminal 10 and the keyboard dock 20 comprise fixation mechanisms 12 and 22, respectively, for detachably connecting the devices 10 and 20. The tablet terminal 10 and the keyboard dock 20 comprise antenna-integrated wireless transmitting and receiving chips 11*a* to 11*d* and 21*a* to 21*d* used for transmitting and receiving the interface signal on the fixation mechanisms 12 and 22 sides, respectively. In the following explanation, of the antenna-integrated wireless transmitting and receiving chips, the chips exclusively used to transmit the interface signal are called TX chips. The chips exclusively used to receive the interface signal are called RX chips.

As explained above, because of the characteristics of millimeter-wave communication, the distance between antennae must be short (specifically, less than or equal to 10 mm) to transmit the interface signal at high speed in accordance with millimeter-wave communication. Thus, the TX chips must be provided so as to face the RX chips between the tablet terminal 10 and the keyboard dock 20. In a case of the detachable computer, the TX chips must face the RX chips between the tablet terminal 10 and the keyboard dock 20 in both the clamshell form and the tablet form. In consideration of the above matters, in the present embodiment, the TX chips and the RX chips are arranged as shown in FIG. 3.

Specifically, as shown in FIG. 3, the TX chips face the RX chips between the tablet terminal 10 and the keyboard dock 20 such that they are bilaterally symmetrical with respect to the axis of rotation (the chips are arranged at regular intervals). For example, in the tablet terminal 10, as shown in FIG. 3, the antenna-integrated wireless transmitting and receiving chips are arranged in the order of TX chip 11*a*, RX chip 11*b*, RX chip 11*c* and TX chip 11*d* from the right side of the figure. In the keyboard dock 20, as shown in FIG. 3, the antenna-integrated wireless transmitting and receiving chips are arranged in the order of RX chip 21*a*, TX chip 21*b*, TX chip 21*c* and RX chip 21*d* from the right side of the figure. With this structure, the TX chips face the RX chips between the tablet terminal 10 and the keyboard dock 20 in both the clamshell form (normal connection state) and the tablet form (reverse connection state). Thus, the short distance between antennae can be maintained. In this way, it is possible to transmit the interface signal at high speed in accordance with millimeter-wave communication.

The arrangement of the TX and RX chips for realizing the high-speed transmission of the interface signal in accordance with millimeter-wave communication is not limited to that of FIG. 3. Specifically, the arrangement of the TX and RX chips on the tablet terminal 10 side may be replaced with that on the keyboard dock 20 side. In other words, in the tablet terminal 10, the antenna-integrated wireless transmitting and receiving chips may be provided in the order of an RX chip, a TX chip, a TX chip and an RX chip. In the keyboard dock 20, the antenna-integrated wireless transmitting and receiving chips may be provided in the order of a TX chip, an RX chip, an RX chip and a TX chip.

Figure 4:
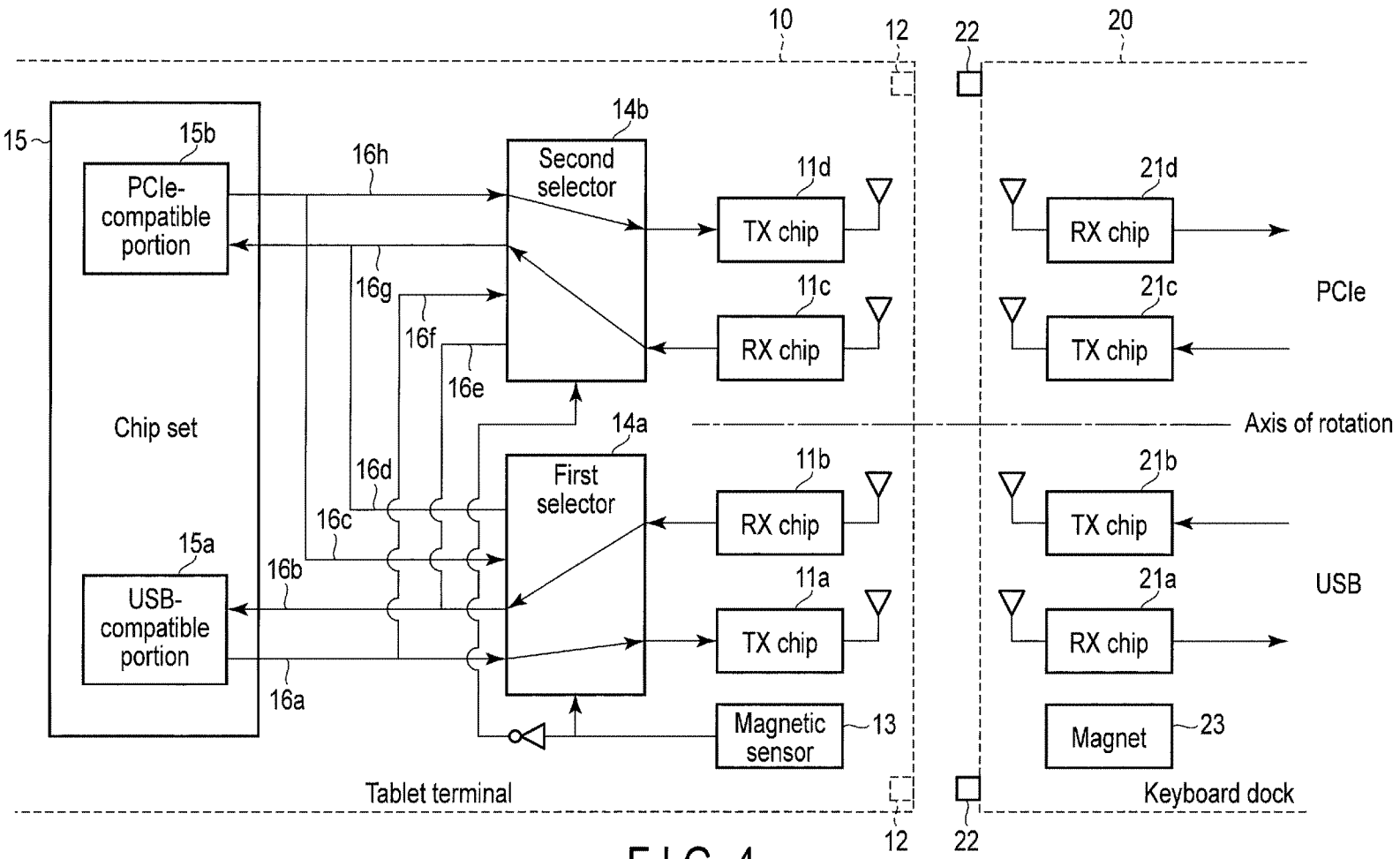
FIG. 4 is shown to explain signal transmission when a tablet terminal and a keyboard dock are in a normal connection state according to the first embodiment.
Figure 5:
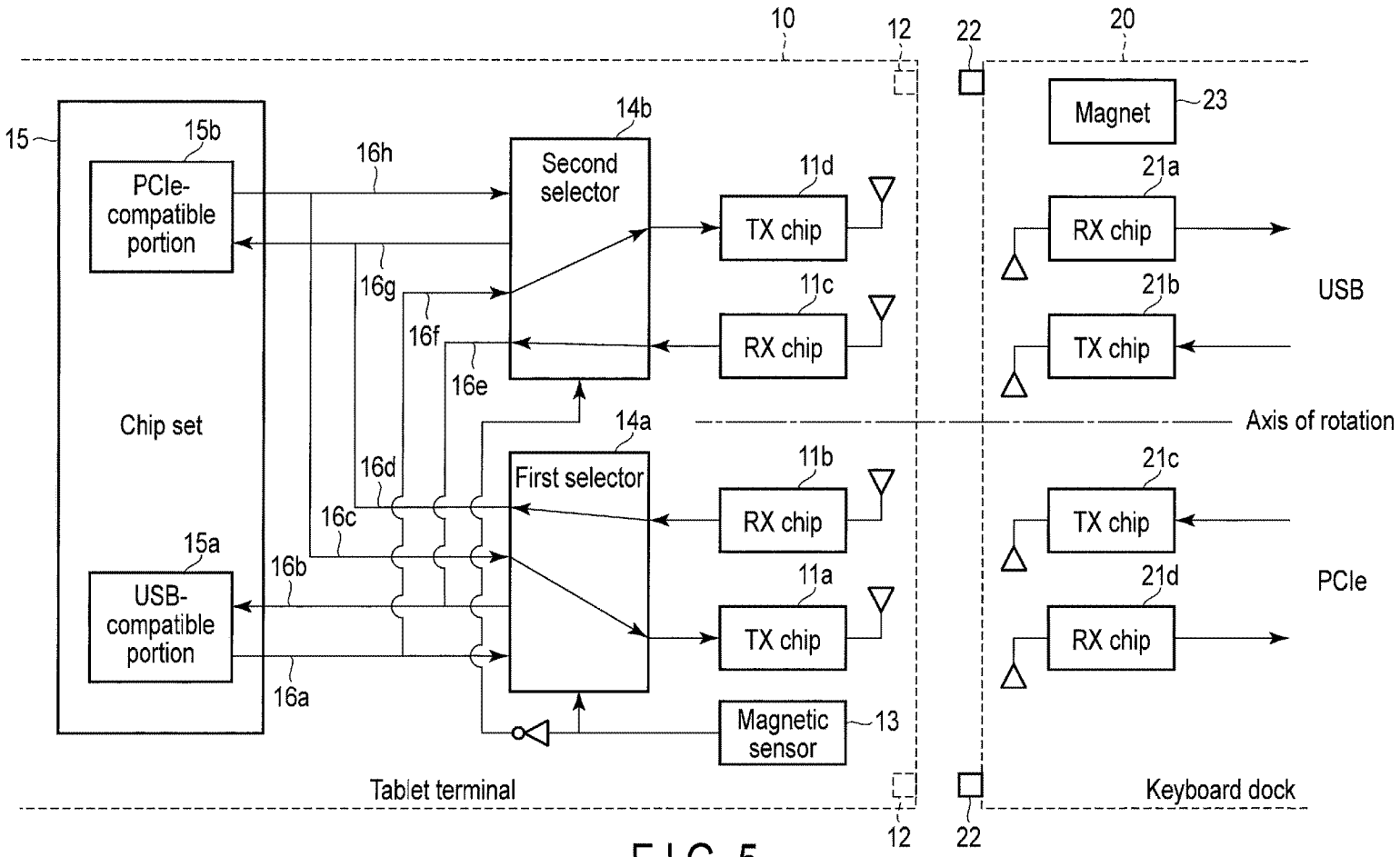
FIG. 5 is shown to explain signal transmission when the tablet terminal and the keyboard dock are in a reverse connection state according to the first embodiment.

Now, this specification explains the structures of the tablet terminal 10 and the keyboard dock 20 in more detail with reference to FIG. 4 and FIG. 5. Further, the signal transmission between the devices 10 and 20 is explained in detail. FIG. 4 is shown to explain signal transmission when the tablet terminal 10 and the keyboard dock 20 are in the normal connection state. FIG. 5 is shown to explain signal transmission when the tablet terminal 10 and the keyboard dock 20 are in the reverse connection state.

As shown in FIG. 4 and FIG. 5, the tablet terminal 10 comprises a magnetic sensor 13, a first selector 14*a*, a second selector 14*b* and a chip set 15 in addition to antenna-integrated wireless transmitting and receiving chips 11*a* to 11*d* and fixation mechanisms 12 shown in FIG. 3. As shown in FIG. 4 and FIG. 5, the keyboard dock 20 comprises a magnet 23 in addition to antenna-integrated wireless transmitting and receiving chips 21*a* to 21*d* and fixation mechanisms 22 shown in FIG. 3.

The magnetic sensor 13 of the tablet terminal 10 is provided so as to face the magnet 23 of the keyboard dock 20 in one of the normal connection state and the reverse connection state. In the present embodiment, as shown in FIG. 4 and FIG. 5, the magnetic sensor 13 of the tablet terminal 10 is provided so as to face the magnet 23 of the keyboard dock 20 in the normal connection state.

Each of selectors 14*a* and 14*b* is connected to a corresponding antenna-integrated wireless transmitting and receiving chip pair 11. Specifically, as shown in FIG. 4 and FIG. 5, the first selector 14*a* is connected to TX chip 11*a* and RX chip 11*b*. The second selector 14*b* is connected to RX chip 11*c* and TX chip 11*d*. Each of selectors 14*a* and 14*b* is connected to the chip set 15 via a signal line 16. Specifically, as shown in FIG. 4 and FIG. 5, selectors 14*a* and 14*b* are connected to signal lines 16*a* and 16*f* for transmitting a TX signal related to an interface conforming to the USB standard, signal lines 16*b* and 16*e* for transmitting an RX signal related to an interface conforming to the USB standard, signal lines 16*c* and 16*h* for transmitting an RX signal related to an interface conforming to the PCI Express standard, and signal lines 16*d* and 16*g* for transmitting a TX signal related to an interface conforming to the PCI Express standard, respectively.

As shown in FIG. 4 and FIG. 5, the chip set 15 comprises a USB-compatible portion 15*a* which manages (controls) the operation of the interface conforming to the USB standard, and a PCIe-compatible portion 15*b* which manages (controls) the operation of the interface conforming to the PCI Express standard. The USB-compatible portion 15*a* is connected to signal lines 16*a* and 16*f* for transmitting the TX signal related to the interface conforming to the USB standard, and signal lines 16*b* and 16*e* for transmitting the RX signal related to the interface conforming to the USB standard. The PCIe-compatible portion 15*b* is connected to signal lines 16*c* and 16*h* for transmitting the RX signal related to the interface conforming to the PCI Express standard, and signal lines 16*d* and 16*g* for transmitting the TX signal related to the interface conforming to the PCI Express standard.

As shown in FIG. 4, when the state of connection between the tablet terminal 10 and the keyboard dock 20 is the normal connection state, the magnetic sensor 13 of the tablet terminal 10 detects a magnetic force produced by the magnet of the keyboard dock 20. The magnetic sensor 13 determines that the state of connection between the tablet terminal 10 and the keyboard dock 20 is the normal connection state, and outputs switching signals to the respective selectors 14*a* and 14*b* in accordance with the normal connection state. Specifically, the magnetic sensor 13 outputs a first switching signal for selecting the USB-compatible portion 15*a* of the chip set 15 to the first selector 14*a*. The magnetic sensor 13 outputs a second switching signal for selecting the PCIe-compatible portion 15*b* of the chip set 15 to the second selector 14*b*.

When the first selector 14*a* receives the input of the first switching signal from the magnetic sensor 13, the first selector 14*a* selects the USB-compatible portion 15*a* (specifically, the signal line connected to the USE-compatible portion 15*a*) compatible with the interface conforming to the USB standard. Thus, the TX signal related to the interface conforming to the USB standard is transmitted to the keyboard dock 20 by TX chip 11*a* via signal line 16*a*, and is received by RX chip 21*a* of the keyboard dock 20. The RX signal related to the interface conforming to the USB standard is transmitted from TX chip 21*b* of the keyboard dock 20, is received by RX chip 11*b* of the tablet terminal 10, and is transmitted to the USB-compatible portion 15*a* of the chip set 15 via signal line 16*b*.

When the second selector 14*b* receives the input of the second switching signal from the magnetic sensor 13, the second selector 14*b* selects the PCIe-compatible portion 15*b* (specifically, the signal line connected to the PCIe-compatible portion 15*b*) compatible with the interface conforming to the PCI Express standard. Thus, the RX signal related to the interface conforming to the PCI Express standard is transmitted from TX chip 21*c* of the keyboard dock 20, is received by RX chip 11*c* of the tablet terminal 10, and is transmitted to the PCIe-compatible portion 15*b* of the chip set 15 via signal line 16*g*. The TX signal related to the interface conforming to the PCI Express standard is transmitted to the keyboard dock 20 by TX chip 11*d* via signal line 16*h*, and is received by RX chip 21*d* of the keyboard dock 20.

As described above, when the state of connection between the tablet terminal 10 and the keyboard dock 20 is the normal connection state, the interface signal can be transmitted at high speed in accordance with millimeter-wave communication.

Now, this specification explains the reverse connection state with reference to FIG. 5.

When the state of connection between the tablet terminal 10 and the keyboard dock 20 is the reverse connection state as shown in FIG. 5, the magnetic sensor 13 of the tablet terminal 10 does not detect a magnetic force produced by the magnet of the keyboard dock 20 although the tablet terminal 10 is connected to the keyboard dock 20. The magnetic sensor 13 determines that the state of connection between the tablet terminal 10 and the keyboard dock 20 is the reverse connection state, and outputs switching signals to the respective selectors 14*a* and 14*b* in accordance with the reverse connection state. Specifically, the magnetic sensor 13 outputs the second switching signal for selecting the PCIe-compatible portion 15*b* of the chip set 15 to the first selector 14*a*. The magnetic sensor 13 outputs the first switching signal for selecting the USB-compatible portion 15*a* of the chip set 15 to the second selector 14*b*.

When the first selector 14*a* receives the input of the second switching signal from the magnetic sensor 13, the first selector 14*a* selects the PCIe-compatible portion 15*b* (specifically, the signal line connected to the PCIe-compatible portion 15*b*) compatible with the interface conforming to the PCI Express standard. Thus, the TX signal related to the interface conforming to the PCI Express standard is transmitted to the keyboard dock 20 by TX chip 11*a* via signal line 16*c*, and is received by RX chip 21*d* of the keyboard dock 20. The RX signal related to the interface conforming to the PCI Express standard is transmitted from TX chip 21*c* of the keyboard dock 20, is received by RX chip 11*b* of the tablet terminal 10, and is transmitted to the PCIe-compatible portion 15*b* of the chip set 15 via signal line 16*d*.

When the second selector 14*b* receives the input of the first switching signal from the magnetic sensor 13, the second selector 14*b* selects the USB-compatible portion 15*a* (the signal line connected to the USB-compatible portion 15*a*) compatible with the interface conforming to the USB standard. Thus, the RX signal related to the interface conforming to the USB standard is transmitted from TX chip 21*b* of the keyboard dock 20, is received by RX chip 11*c* of the tablet terminal 10, and is transmitted to the USB-compatible portion 15*a* of the chip set 15 via signal line 16*e*. The TX signal related to the interface conforming to the USB standard is transmitted to the keyboard dock 20 by TX chip 11*d* via signal line 16*f*, and is received by RX chip 21*a* of the keyboard dock 20.

As described above, even when the state of connection between the tablet terminal 10 and the keyboard dock 20 is the reverse connection state, the interface signal can be transmitted at high speed in accordance with millimeter-wave communication.

In the present embodiment, as shown in FIG. 5, the reverse connection state is explained with an example in which the keyboard dock 20 is reversed instead of the tablet terminal 10. However, even when the tablet terminal 10 is reversed, the interface signal can be transmitted at high speed in accordance with millimeter-wave communication in the same manner.

In the present embodiment, as shown in FIG. 4 and FIG. 5, the magnetic sensor 13 is provided in the tablet terminal 10, and further, the magnet 23 is provided in the keyboard dock 20. The determination of whether the magnetic sensor 13 detects a magnetic force produced by the magnet 23 is used to determine whether the state of connection between the tablet terminal 10 and the keyboard dock 20 is the normal connection state or the reverse connection state.

However, the method for determining the state of connection is not limited to this example, and may be realized by an arbitrary known method.

In the present embodiment, as shown in FIG. 4 and FIG. 5, the first selector 14*a* and the second selector 14*b* are provided in the tablet terminal 10. However, selectors 14*a* and 14*b* may be provided on the keyboard dock 20 side. In this case, in place of the magnetic sensor 13, the magnet 23 is provided in the tablet terminal 10. In place of the magnet 23, the magnetic sensor 13 is provided in the keyboard dock 20.

In the present embodiment, the device detachably connected to the tablet terminal 10 is the keyboard dock 20. However, the device is not limited to this example, and may be an arbitrary device as long as it exchanges the interface signal with the tablet terminal 10.

In the detachable computer of the first embodiment explained above, the TX chips face the RX chips between the tablet terminal 10 and the keyboard dock 20 such that they are bilaterally symmetrical with respect to the axis of rotation. With this structure, the TX chips (RX chips) provided in the tablet terminal 10 and the RX chips (TX chips) provided in the keyboard dock 20 are allowed to be located within a distance in which the interface signal can be transmitted at high speed in accordance with millimeter-wave communication when the state of connection between the tablet terminal 10 and the keyboard dock 20 is either the normal connection state or the reverse connection state. Thus, the interface signal can be transmitted at high speed in accordance with millimeter-wave communication.

<Second Embodiment>

Now, this specification explains a second embodiment. In the present embodiment, each TX chip is not a separate element from an RX chip for transmitting an interface signal in accordance with millimeter-wave communication. Instead, the present embodiment comprises antenna-integrated wireless communication chips each having both the transmitting function of TX chips and the receiving function of RX chips. In this respect, the present embodiment is different from the first embodiment. Moreover, in the present embodiment, the interface signals transmittable between the tablet terminal 10 and the keyboard dock 20 are the USB signal related to the interface conforming to the USB standard, and an HDMI signal related to an interface conforming to the High-Definition Multimedia Interface (HDMI) standard. The present embodiment is different from the first embodiment in this respect as well. Further, the present embodiment is different from the first embodiment in respect that the antenna-integrated wireless communication chips are allowed to switch the transmission mode between a USB signal transmission mode for transmitting the USB signal and an HDMI signal transmission mode for transmitting the HDMI signal. Thus, the present embodiment has the advantage that there is no need to provide the first or second selector 14*a* or 14*b* in the tablet terminal 10.

Figure 6:
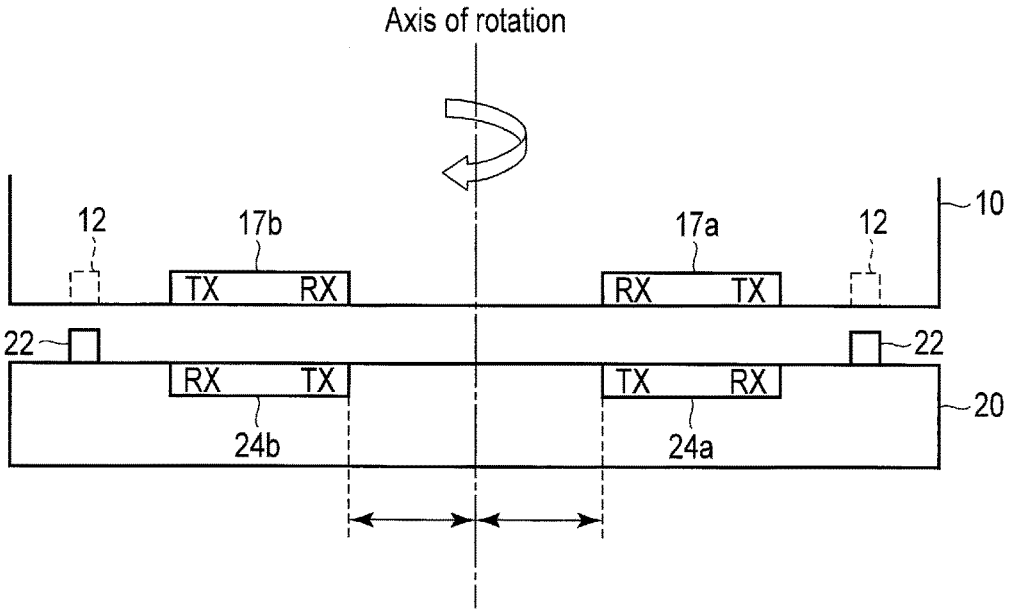
FIG. 6 shows an example of arrangement of antenna-integrated wireless communication chips according to a second embodiment.

FIG. 6 shows an example of arrangement of antenna-integrated wireless communication chips according to the second embodiment.

As shown in FIG. 6, antenna-integrated wireless communication chips 17*a*, 17*b*, 24*a* and 24*b* which are allowed to switch the transmission mode between the USB signal transmission mode and the HDMI signal transmission mode are provided on the fixation mechanism (12, 22) sides of the tablet terminal 10 and the keyboard dock 20. In this case, similarly, because of the characteristics of millimeter-wave communication, the distance between antennae must be short to transmit the interface signal at high speed in accordance with millimeter-wave communication. Thus, transmitting antenna portions (antenna portions exclusively used for transmission or TX antenna portions) must be provided so as to face receiving antenna portions (antenna portions exclusively used for reception or RX antenna portions) in antenna-integrated wireless communication chips 17*a*, 17*b*, 24*a* and 24*b* between the tablet terminal 10 and the keyboard dock 20. In a case of the detachable computer, as explained above, the transmitting antenna portions must face the receiving antenna portions in antenna-integrated wireless communication chips 17*a*, 17*b*, 24*a* and 24*b* between the tablet terminal 10 and the keyboard dock 20 in both the clamshell form and the tablet form. In consideration of the above matters, in the present embodiment, the antenna-integrated wireless communication chips are arranged as shown in FIG. 6.

Specifically, as shown in FIG. 6, the transmitting antenna portions face the receiving antenna portions in the antenna-integrated wireless communication chips between the tablet terminal 10 and the keyboard dock 20 such that they are bilaterally symmetrical with respect to the axis of rotation (the antenna portions are arranged at regular intervals). For example, two antenna-integrated wireless communication chips 17*a* and 17*b* are provided in the tablet terminal 10 to transmit two types of interface signals, specifically, the USB signal and the HDMI signal. As shown in FIG. 6, in antenna-integrated wireless communication chip 17*a* on the right side of the figure, the transmitting antenna portion and the receiving antenna portion are provided in the order of the transmitting antenna portion and the receiving antenna portion from the right side of the figure. In antenna-integrated wireless communication chip 17*b* on the left side of the figure, the transmitting antenna portion and the receiving antenna portion are provided in the order of the receiving antenna portion and the transmitting antenna portion from the right side of the figure. In the keyboard dock 20, in a manner similar to that of the tablet terminal 10, two antenna-integrated wireless communication chips 24*a* and 24*b* are provided to transmit two types of interface signals, specifically, the USB signal and the HDMI signal. As shown in FIG. 6, in antenna-integrated wireless communication chip 24*a* on the right side of the figure, the transmitting antenna portion and the receiving antenna portion are provided in the order of the receiving antenna portion and the transmitting antenna portion from the right side of the figure. In antenna-integrated wireless communication chip 24*b* on the left side of the figure, the transmitting antenna portion and the receiving antenna portion are provided in the order of the transmitting antenna portion and the receiving antenna portion from the right side of the figure. With this structure, the transmitting antenna portions face the receiving antenna portions in the antenna-integrated wireless communication chips between the tablet terminal 10 and the keyboard dock 20 in both the clamshell form (normal connection state) and the tablet form (reverse connection state). Thus, the short distance between antennae can be maintained. In this way, the interface signal can be transmitted at high speed in accordance with millimeter-wave communication.

The arrangement of the antenna-integrated wireless communication chips for transmitting the interface signal at high speed in accordance with millimeter-wave communication is not limited to that shown in FIG. 6. Specifically, the arrangement of the transmitting antenna portions and the receiving antenna portions in the antenna-integrated wireless communication chips on the tablet terminal 10 side may be replaced with that on the keyboard dock 20 side. In other words, in the tablet terminal 10, the antenna-integrated wireless communication chips may be arranged in the order of a receiving antenna portion, a transmitting antenna portion, a transmitting antenna portion and a receiving antenna portion. In the keyboard dock 20, the antenna-integrated wireless communication chips may be arranged in the order of a transmitting antenna portion, a receiving antenna portion, a receiving antenna portion and a transmitting antenna portion.

Figure 7:
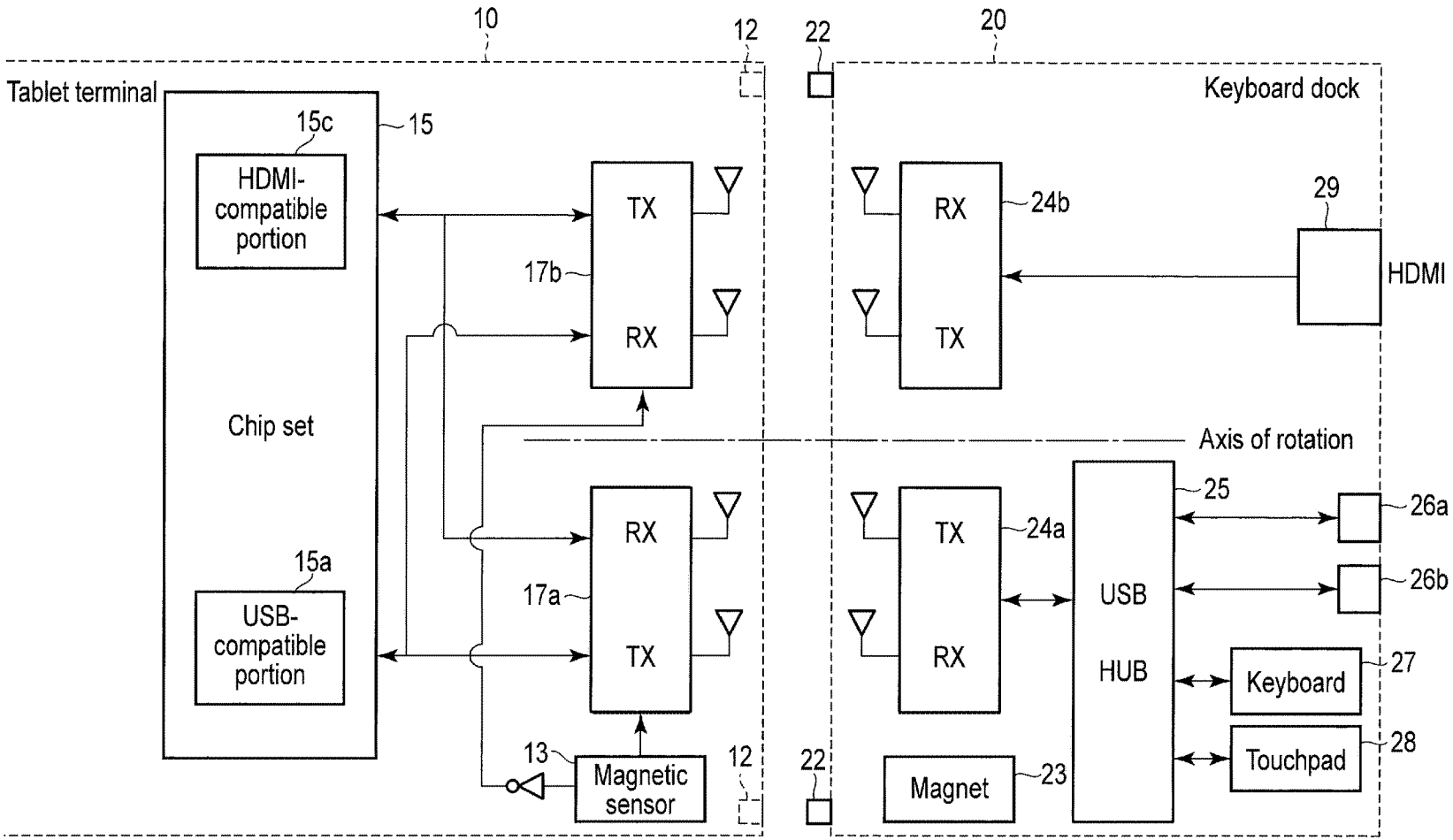
FIG. 7 is shown to explain signal transmission when a tablet terminal and a keyboard dock are in a normal connection state according to the second embodiment.
Figure 8:
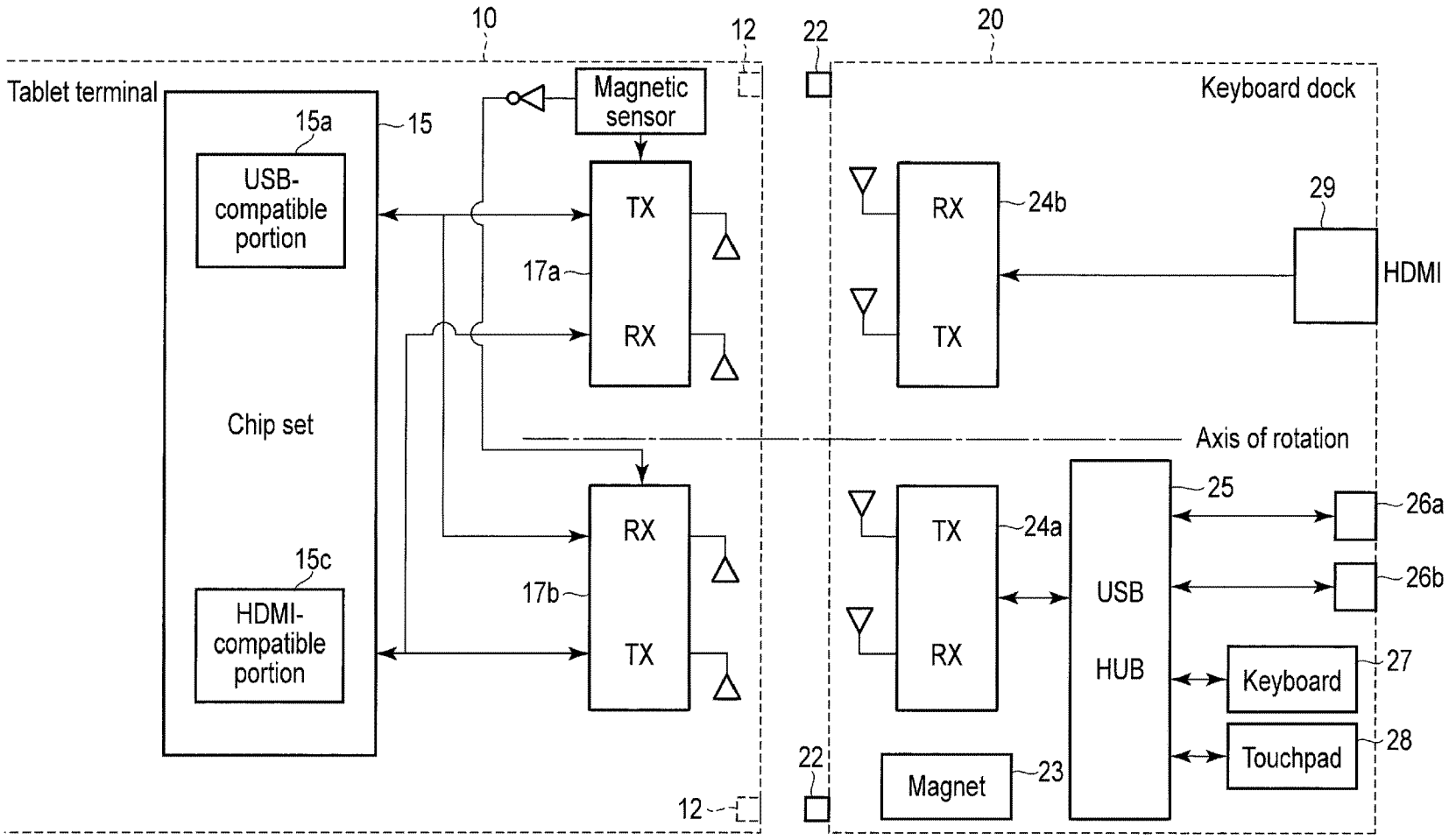
FIG. 8 is shown to explain signal transmission when the tablet terminal and the keyboard dock are in a reverse connection state according to the second embodiment.

Now, this specification explains the details of signal transmission between the tablet terminal 10 and the keyboard dock 20 in the present embodiment with reference to FIG. 7 and FIG. 8. FIG. 7 is shown to explain signal transmission when the tablet terminal 10 and the keyboard dock 20 are in the normal connection state. FIG. 8 is shown to explain signal transmission when the tablet terminal 10 and the keyboard dock 20 are in the reverse connection state.

As shown in FIG. 7 and FIG. 8, the tablet terminal 10 comprises fixation mechanisms 12, a magnetic sensor 13, a chip set 15, and antenna-integrated wireless communication chips 17*a* and 17*b*. The chip set 15 further comprises a USB-compatible portion 15*a* which controls (manages) the operation of the interface conforming to the USB standard, and an HDMI-compatible portion 15*c* which controls (manages) the operation of an interface conforming to the HDMI standard. Antenna-integrated wireless communication chips 17*a* and 17*b* are connected to the USB-compatible portion 15*a* and the HDMI-compatible portion 15*c*, in the chip set 15. Chips 17*a* and 17*b* switch the signal transmission mode in accordance with a mode switching signal from the magnetic sensor 13, and exchange the interface signal with the USB-compatible portion 15*a* and the HDMI-compatible portion 15*c* in the chip set 15.

As shown in FIG. 7 and FIG. 8, the keyboard dock 20 comprises fixation mechanisms 22, a magnet 23, antenna-integrated wireless communication chips 24*a* and 24*b*, a USB hub 25, USB ports 26*a* and 26*b*, a keyboard 27, a touchpad 28, and an HDMI port 29. The USB hub 25 is connected to antenna-integrated wireless communication chip 24*a*. The HDMI port 29 is connected to antenna-integrated wireless communication chip 24*b*. Thus, the signal transmission mode of antenna-integrated wireless communication chip 24*a* is fixed to a USE signal transmission mode. The signal transmission mode of antenna-integrated wireless communication chip 24*b* is fixed to an HDMI signal transmission mode. USB ports 26*a* and 26*b*, the keyboard 27 and the touchpad 28 are connected to the USB hub 25.

As shown in FIG. 7, when the state of connection between the tablet terminal 10 and the keyboard dock 20 is the normal connection state, the magnetic sensor 13 of the tablet terminal 10 detects a magnetic force produced by the magnet 23 of the keyboard dock 20. In this manner, the magnetic sensor 13 determines that the state of connection between the tablet terminal 10 and the keyboard dock 20 is the normal connection state, and outputs mode switching signals to the respective antenna-integrated wireless communication chips 17*a* and 17*b* in accordance with the normal connection state. Specifically, the magnetic sensor 13 outputs a first mode switching signal for switching the signal transmission mode to the USB signal transmission mode to antenna-integrated wireless communication chip 17*a*. The magnetic sensor 13 outputs a second mode switching signal for switching the signal transmission mode to the HDMI signal transmission mode to antenna-integrated wireless communication chip 17*b*.

When antenna-integrated wireless communication chip 17*a* receives the input of the above first mode switching signal from the magnetic sensor 13, antenna-integrated wireless communication chip 17*a* sets the signal transmission mode to the USB signal transmission mode. In this way, the signal transmission mode of antenna-integrated wireless communication chip 17*a* can be the USB signal transmission mode in the same manner as the opposite antenna-integrated wireless communication chip 24*a* on the keyboard dock 20 side as shown in FIG. 7. Thus, the USB signal can be transmitted at high speed in accordance with millimeter-wave communication between the tablet terminal 10 and the keyboard dock 20.

When antenna-integrated wireless communication chip 17*b* receives the input of the above second mode switching signal from the magnetic sensor 13, antenna-integrated wireless communication chip 17*b* sets the signal transmission mode to the HDMI signal transmission mode. In this way, the signal transmission mode of antenna-integrated wireless communication chip 17*b* can be the HDMI signal transmission mode in the same manner as the opposite antenna-integrated wireless communication chip 24*b* on the keyboard dock 20 side as shown in FIG. 7. Thus, the HDMI signal can be transmitted at high speed in accordance with millimeter-wave communication between the tablet terminal 10 and the keyboard dock 20.

As described above, when the state of connection between the tablet terminal 10 and the keyboard dock 20 is the normal connection state, the interface signal can be transmitted at high speed in accordance with millimeter-wave communication.

This specification further explains a case of reverse connection state with reference to FIG. 8.

When the state of connection between the tablet terminal 10 and the keyboard dock 20 is the reverse connection state as shown in FIG. 8, the magnetic sensor 13 of the tablet terminal 10 does not detect a magnetic force produced by the magnet 23 of the keyboard dock 20 although the tablet terminal 10 is connected to the keyboard dock 20. In this manner, the magnetic sensor 13 determines that the state of connection between the tablet terminal 10 and the keyboard dock 20 is the reverse connection state, and outputs mode switching signals to the respective antenna-integrated wireless communication chips 17*a* and 17*b* in accordance with the reverse connection state. Specifically, the magnetic sensor 13 outputs the second mode switching signal for switching the signal transmission mode to the HDMI signal transmission mode to antenna-integrated wireless communication chip 17*a*. The magnetic sensor 13 outputs the first mode switching signal for switching the signal transmission mode to the USB signal transmission mode to antenna-integrated wireless communication chip 17*b*.

When antenna-integrated wireless communication chip 17*a* receives the input of the above second mode switching signal from the magnetic sensor 13, antenna-integrated wireless communication chip 17*a* sets the signal transmission mode to the HDMI signal transmission mode. In this way, the signal transmission mode of antenna-integrated wireless communication chip 17*a* can be the HDMI signal transmission mode in the same manner as the opposite antenna-integrated wireless communication chip 24*b* on the keyboard dock 20 side as shown in FIG. 8. Thus, the HDMI signal can be transmitted at high speed in accordance with millimeter-wave communication between the tablet terminal 10 and the keyboard dock 20.

When antenna-integrated wireless communication chip 17*b* receives the input of the above first mode switching signal from the magnetic sensor 13, antenna-integrated wireless communication chip 17*b* sets the signal transmission mode to the USB signal transmission mode. In this way, the signal transmission mode of antenna-integrated wireless communication chip 17*b* can be the USB signal transmission mode in the same manner as the opposite antenna-integrated wireless communication chip 24*a* on the keyboard dock 20 side as shown in FIG. 8. Thus, the USB signal can be transmitted at high speed in accordance with millimeter-wave communication between the tablet terminal 10 and the keyboard dock 20.

As described above, when the state of connection between the tablet terminal 10 and the keyboard dock 20 is the reverse connection state, the interface signal can be transmitted at high speed in accordance with millimeter-wave communication.

In the present embodiment, as shown in FIG. 8, the reverse connection state is explained with an example in which the tablet terminal 10 is reversed instead of the keyboard dock 20. However, even when the keyboard dock 20 is reversed, the interface signal can be transmitted at high speed in accordance with millimeter-wave communication in the same manner.

The detachable computer of the second embodiment explained above comprises the antenna-integrated wireless communication chips in which the transmitting antenna portions face the receiving antenna portions between the tablet terminal 10 and the keyboard dock 20 such that they are bilaterally symmetrical with respect to the axis of rotation. With this structure, when the state of connection between the tablet terminal 10 and the keyboard dock 20 is either the normal connection state or the reverse connection state, the transmitting antenna portions (receiving antenna portions) of the antenna-integrated wireless communication chips provided in the tablet terminal 10 and the receiving antenna portions (transmitting antenna portions) of the antenna-integrated wireless communication chips provided in the keyboard dock 20 can be located within a distance allowed to transmit the interface signal at high speed in accordance with millimeter-wave communication. Thus, the interface signal can be transmitted at high speed in accordance with millimeter-wave communication.

According to at least one of the above embodiments, even when one of the tablet terminal 10 and the keyboard dock 20 does not comprise transmitting and receiving antennae for the normal connection state and transmitting and receiving antennae for the reverse connection state, the interface signal can be transmitted at high speed in accordance with millimeter-wave communication in either connection state. In this way, it is possible to decrease the cost for manufacturing the tablet terminal 10 and the keyboard dock 20.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A system comprising:

a first electronic device;

a second electronic device connected to the first electronic device in a normal connection state or a reverse connection state;

a first antenna-integrated transmitting and receiving chip for transmitting and receiving a signal on a first interface of a millimeter wave communication and a second antenna-integrated transmitting and receiving chip for transmitting and receiving a signal on a second interface of a millimeter wave communication, which are provided in the first electronic device;

a third antenna-integrated transmitting and receiving chip facing the first transmitting and receiving chip and a fourth antenna-integrated transmitting and receiving chip facing the second transmitting and receiving chip, which are provided in the second electronic device;

a first selector outputting the signal on the first interface to the first transmitting and receiving chip or the second transmitting and receiving chip and a second selector outputting the signal on the second interface to the second transmitting and receiving chip or the first transmitting and receiving chip, which are provided in the first electronic device; and a sensor controlling selection in the first selector and the second selector with a signal indicating a connection state of the first electronic device and the second electronic device, wherein if the signal of the sensor indicates the normal connection state, the first selector selects the signal on the first interface and outputs the signal to the first transmitting and receiving chip, and the second selector selects the signal on the second interface and outputs the signal to the second transmitting and receiving chip, and if the signal of the sensor indicates the reverse connection state, the first selector selects the signal on the second interface and outputs the signal to the second transmitting and receiving chip, and the second selector selects the signal on the first interface and outputs the signal to the first transmitting and receiving chip.

2. The system of claim 1, wherein the first antenna-integrated transmitting and receiving chip included in the first electronic device comprises a first antenna, a first transmitting chip, a second antenna, and a first receiving chip, and the second antenna-integrated transmitting and receiving chip included in the first electronic device comprises a third antenna, a second receiving chip, a fourth antenna, and a second transmitting chip.

3. The system of claim 2, wherein the third antenna-integrated transmitting and receiving chip included in the second electronic device comprises a fifth antenna, a third receiving chip, a sixth antenna, and a third transmitting chip, and the fourth antenna-integrated transmitting and receiving chip included in the second electronic device comprises a seventh antenna, a fourth transmitting chip, an eighth antenna, and a fourth receiving chip.

4. The system of claim 3, wherein the chips of the second interface side are arranged in lateral symmetry in order of the third receiving chip, the third transmitting chip, the fourth transmitting chip, and the fourth receiving chip.

5. The system of claim 3, wherein the chips of the second interface side are arranged in lateral symmetry in order of the third transmitting chip, the third receiving chip, the fourth receiving chip, and the fourth transmitting chip.

6. The system of claim 3, wherein if the state of the connection between the first electronic device and the second electronic device is the normal connection state, the first transmitting chip integrated with the first antenna faces the third receiving chip integrated with the fifth antenna, the first receiving chip integrated with the second antenna faces the third transmitting chip integrated with the sixth antenna, the second receiving chip integrated with the third antenna faces the fourth transmitting chip integrated with the seventh antenna, and the second transmitting chip integrated with the fourth antenna faces the fourth receiving chip integrated with the eighth antenna.

7. The system of claim 3, wherein if the state of the connection between the first electronic device and the second electronic device is the reverse connection state, the first transmitting chip integrated with the first antenna faces the fourth receiving chip integrated with the eighth antenna, the first receiving chip integrated with the second antenna faces the fourth transmitting chip integrated with the seventh antenna, the second receiving chip integrated with the third antenna faces the third transmitting chip integrated with the sixth antenna, and the second transmitting chip integrated with the fourth antenna faces the third receiving chip integrated with the fifth antenna.

8. The system of claim 2, wherein the chips of the first interface side are arranged in lateral symmetry in order of the first transmitting chip, the first receiving chip, the second receiving chip, and the second transmitting chip.

9. The system of claim 2, wherein the chips of the first interface side are arranged in lateral symmetry in order of the first receiving chip, the first transmitting chip, the second transmitting chip, and the second receiving chip.

10. The system of claim 1, wherein the sensor comprises a magnet provided in the second electronic device and a magnetic sensor provide in the first electronic device, when the magnetic sensor detects a magnetic force produced by the magnet, the magnetic sensor determines that a state of connection with the first electronic device is the normal connection state, outputs a first switching signal corresponding to the normal connection state to the first selector, and outputs a reverse signal of the first switching signal to the second selector, and when the magnetic sensor does not detect a magnetic force produced by the magnet, the magnetic sensor determines that the state of connection with the first electronic device is the reverse connection state, outputs a second switching signal corresponding to the reverse connection state to the first selector, and outputs a reverse signal of the second switching signal to the second selector.

11. The system of claim 1, wherein the signal on the first interface is a signal on a USB interface, and the signal on the second interface is a PCI Express interface.

12. The system of claim 1, wherein the signal on the first interface is a signal on a USB interface, and the signal on the second interface is an HDMI interface.

13. A tablet-type electronic device connected to a keyboard dock in a normal connection state or a reverse connection state, comprising:

a first antenna-integrated transmitting and receiving chip for transmitting and receiving a signal on a first interface of a millimeter wave communication and a second antenna-integrated transmitting and receiving chip for transmitting and receiving a signal on a second interface of a millimeter wave communication;

a first selector outputting the signal on the first interface to the first transmitting and receiving chip or the second transmitting and receiving chip and a second selector outputting the signal on the second interface to the second transmitting and receiving chip or the first transmitting and receiving chip; and a sensor controlling selection in the first selector and the second selector with a signal indicating a state of the connection to the keyboard dock, wherein if the signal of the sensor indicates that the state of the connection to the keyboard dock is the normal connection state, the first selector selects the signal on the first interface and outputs the signal to the first transmitting and receiving chip, and the second selector selects the signal on the second interface and outputs the signal to the second transmitting and receiving chip, and if the signal of the sensor indicates that the state of the connection to the keyboard dock is the reverse connection state, the first selector selects the signal on the second interface and outputs the signal to the second transmitting and receiving chip, and the second selector selects the signal on the first interface and outputs the signal to the first transmitting and receiving chip.

14. The electronic device of claim 13, wherein the signal on the first interface is a signal on a USB interface, and the signal on the second interface is a PCI Express interface.

15. The electronic device of claim 13, wherein the signal on the first interface is a signal on a USB interface, and the signal on the second interface is an HDMI interface.

* * * * *